US007980914B1

(12) United States Patent
Blais et al.

(10) Patent No.: US 7,980,914 B1
(45) Date of Patent: Jul. 19, 2011

(54) SPLASH PAD KITS

(76) Inventors: Luke A. Blais, Ladera Ranch, CA (US); Walter Brett Ferguson, Queen Creek, AZ (US)

( * ) Notice: Subject to any disclaimer, the term of this patent is extended or adjusted under 35 U.S.C. 154(b) by 423 days.

(21) Appl. No.: 12/144,576

(22) Filed: Jun. 23, 2008

Related U.S. Application Data

(60) Provisional application No. 60/945,540, filed on Jun. 21, 2007.

(51) Int. Cl.
*A63H 23/16* (2006.01)
*A63H 23/00* (2006.01)

(52) U.S. Cl. ..... 446/128; 4/488

(58) Field of Classification Search ..... 472/117, 472/128, 129; 4/488, 506, 507, 509; 446/153, 446/267, 483
See application file for complete search history.

(56) References Cited

U.S. PATENT DOCUMENTS

| | | | | |
|---|---|---|---|---|
| 5,366,618 | A * | 11/1994 | Foster | 210/138 |
| 5,820,471 | A * | 10/1998 | Briggs | 472/128 |
| 6,189,556 | B1 | 2/2001 | Blake et al. | |
| 6,319,139 | B1 * | 11/2001 | Tracy | 472/128 |
| 6,325,087 | B1 | 12/2001 | Tarr | |
| 6,390,447 | B1 | 5/2002 | Mosher | |
| 6,539,967 | B2 | 4/2003 | Tarr | |
| 6,702,687 | B1 * | 3/2004 | Henry | 472/128 |
| 6,739,979 | B2 * | 5/2004 | Tracy | 472/128 |
| D495,087 | S | 8/2004 | Brown et al. | |

OTHER PUBLICATIONS

Rain Drop Products LLC, Interactive Water Play, Screen shot of http://web.archive.org/web/20051031032748/www.rain-drop.com/products.aspx; web page archived in Oct. 2005.

Rain Drop Products, LLC, Interactive Water Play, Screen shot of http://web.archive.org/web/20060320012920/www.rain-drop.com/groupdetail.aspx?group=3; web page archived in Mar. 2006.

Rain Drop Products, LLC, Interactive Water Play, Screen shot of http://web.archive.org/web/20060320013040/www.rain-drop.com/productDetail.aspx?id=79 web page archived in Mar. 2006.

Rain Drop Products, LLC, Specification sheet for Skid Mount Equipment Package; document created in Nov. 2005.

Rain Drop Products, LLC, Screen shot of http://web.archive.org/web/20070613070530/http://www.rain-drop.com/; web page archived Jun. 13, 2007.

Rain Drop Products, LLC—CAD drawings of "Omnipod"; document dated Mar. 2006.

Vortex, Screen shot of website depicting operating systems http://web.archive.org/web/20061019225121/www.vortex-intl.com/index... ; web page archived in Oct. 2006.

Vortex, Screen shot of website depicting Splash pad samples, http://web.archive.org/web/20061019230036/www.vortex-intl.com/index... ; web page archived in Oct. 2006.

Vortex, Screen shot of website depicting water source options, http://web.archive.org/web/20061019230129/www.vortex-intl.com/index... ; web page archived in Oct. 2006.

(Continued)

*Primary Examiner* — Kien T Nguyen
(74) *Attorney, Agent, or Firm* — Knobbe Martens Olson & Bear, LLP

(57) ABSTRACT

Described are variations of a residential splash-pad system and kit for installation thereof. A system can comprise a residential water pump, a water filter, a water distribution valve, nozzles, a controller, and a drain. Some variations can include a heater, an ozonator, a ball valve, a three-way valve, an above-ground water feature, and/or a pool. The components can be compatible with and ready for installation in a system with each of the other components.

17 Claims, 12 Drawing Sheets

OTHER PUBLICATIONS

Waterplay Manufacturing Inc., catalog, www.waterplay.com; document created in Sep. 2005 and available through web page archived in Nov. 2006.

Water Odyssey, Screen shot of website, http://web.archive.org/web/20060203160358/http://waterodyssey.com/; web page archived in Feb. 2006.

* cited by examiner

SPLASH PAD KITS

CROSS-REFERENCE TO RELATED APPLICATIONS

This application claims the benefit under 35 U.S.C. §119 (e) of U.S. Provisional Patent Application No. 60/945,540, entitled "SPLASH PAD KITS," filed Jun. 21, 2007, which is hereby incorporated by reference in its entirety and made part of this specification.

BACKGROUND OF THE INVENTION

1. Field of the Invention

The disclosed inventions relate to residential and/or commercial splash pads, water features, water parks and swimming pools.

2. Description of the Related Art

Most splash pads are not configured for residential applications and/or affordable commercial installations, and they have other drawbacks. Inventions disclosed herein address the compilation of proprietary splash pad parts that address the problems in the existing products.

BRIEF DESCRIPTION OF THE DRAWINGS

The following drawings and the associated descriptions are provided to illustrate embodiments of the present disclosure and do not limit the scope of the claims.

Figure 1:
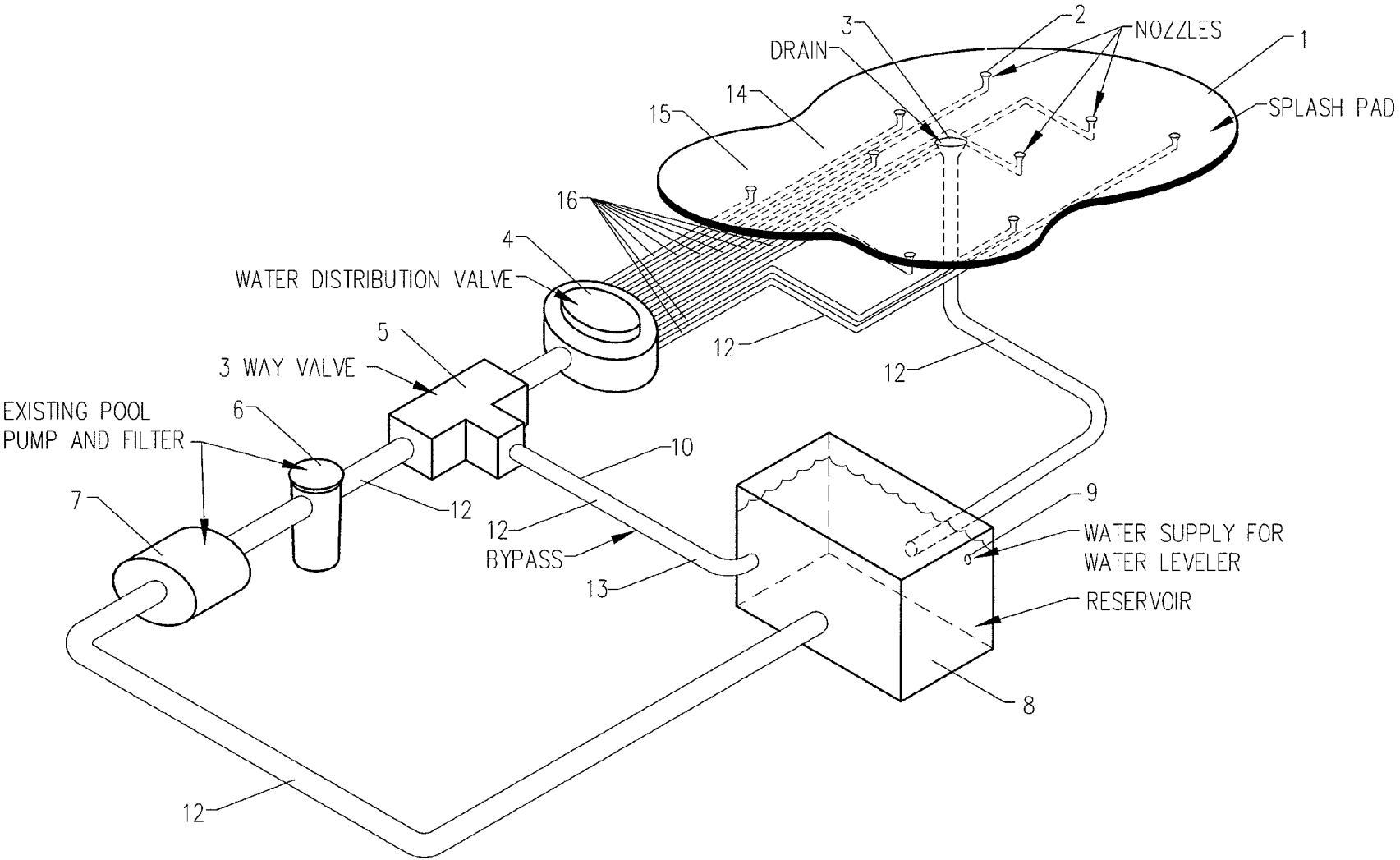
FIG. 1 shows an embodiment of a Stand-Alone Splash Pad Kit

These and other features will now be described with reference to the drawings summarized above. The drawings and the associated descriptions are provided to illustrate embodiments and not to limit the scope of any claim. Throughout the drawings, reference numbers may be reused to indicate correspondence between referenced elements.

DETAILED DESCRIPTION OF THE PREFERRED EMBODIMENT

Although certain preferred embodiments and examples are disclosed below, inventive subject matter extends beyond the specifically disclosed embodiments to other alternative embodiments and/or uses and to modifications and equivalents thereof. Thus, the scope of the claims appended hereto is not limited by any of the particular embodiments described below. For example, in any method or process disclosed herein, the acts or operations of the method or process may be performed in any suitable sequence and are not necessarily limited to any particular disclosed sequence. Various operations may be described as multiple discrete operations in turn, in a manner that may be helpful in understanding certain embodiments; however, the order of description should not be construed to imply that these operations are order dependent. Additionally, the structures, systems, and/or devices described herein may be embodied as integrated components or as separate components. For purposes of comparing various embodiments, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein.

The disclosed inventions relate to residential and/or commercial splash pads. The unique splash pad kits described herein can allow an installer or a direct consumer the ability to purchase all necessary hardware in one unique kit (package or system) to install a splash pad.

A splash pad is an area for water play that has very minimal or no standing water. Typically in a splash pad are inset nozzles FIGS. 3 through 8 that spray water upward 15 along with other above surface water features FIG. 9 that release water. The splash pad 1 can have a concrete surface 14 or other materials can be used, such as rubber or other soft surfacing material. The splash pad can be activated using a timer, motion sensor or activation button and the water features can be activated all together or individually. The water for the splash pad can be recycled to a holding tank 8 where it is pulled by a pump 7, filtered 6, treated and recycled back through either the water features or returned directly back to the holding tank 8. A 3-way valve 5 or similar directional valve controls the flow of water through either the water distribution valve 4 or returned back to the holding tank 8.

Figure 2:
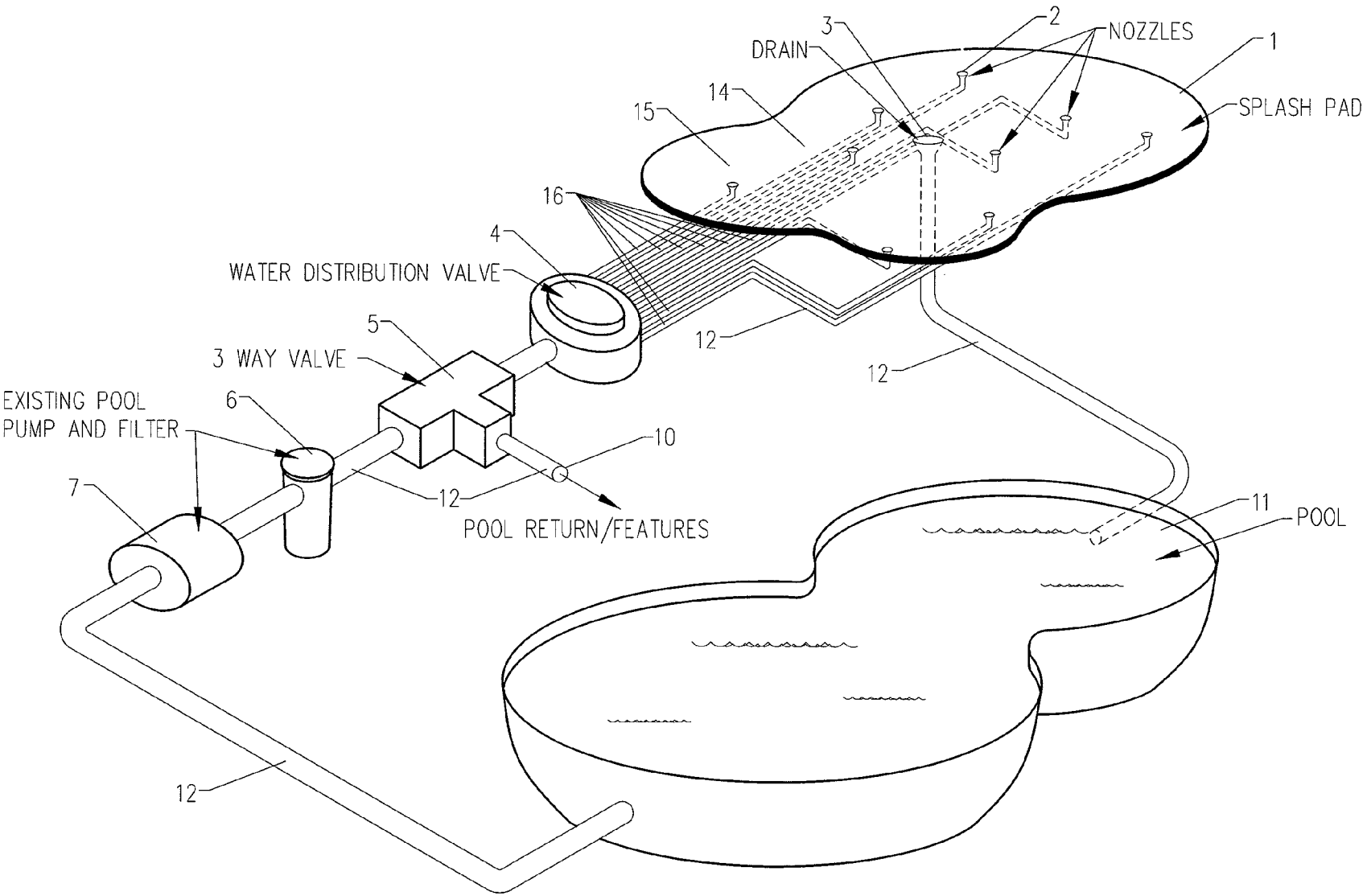
FIG. 2 shows an embodiment of a Swimming Pool Splash Pad Kit

A splash pad kit FIG. 1 or FIG. 2 can include several components. Water pump 7 and filter 6 can be used to propel and to clean the water held in a holding tank 8. If desired a heating element can be added to the system to provide warmed water. The water is fed through a water distribution valve 5 that distributes the water to multiple feed lines 16 which may be individually controlled by ball valves or other similar water restriction valves. The water pressure from the water distribution valve 5 forces the water to the individual splash pad housings/nozzles 2 which spray the water into the air 15 or through the other water features FIG. 9. In some versions, the nozzle is a substantially round disk and is sometimes referred to as a "puck." The water can come forth from the nozzles in many shapes, sprays, configurations and velocities, depending on how the flow path through the nozzle is configured.

Figure 9:
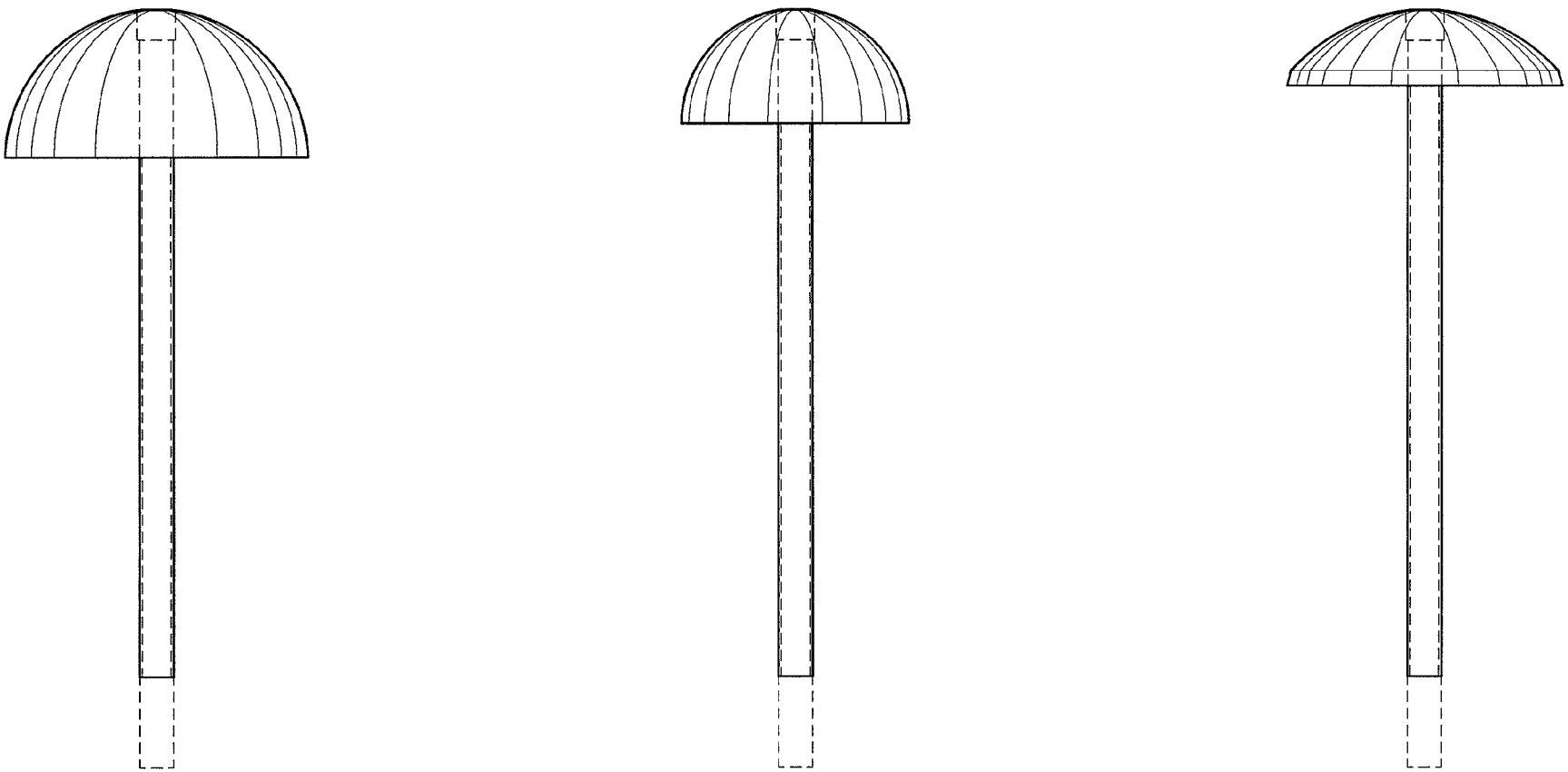
FIG. 9 shows an embodiment of an Above Ground Water Feature(s).

The water from a holding tank 8 or swimming pool 11 can also be pumped into an above ground water feature FIG. 9 that will release the water in a variety of fashions. The water from these features lands upon the surface 14 of the splash pad 1 that can be coated or covered in a variety of surface material. The following are just some of the surface materials that can be used in the construction of the splash pad finished surface: rubber, acrylic, tile, stamped concrete, colored concrete, raw concrete, pavers, stone slab, asphalt, none-slip materials, thermoplastic rubber, pebble flex. The water flows to a drain(s) 3 to ensure minimal or zero standing water upon the splash pad 1. The drain(s) 3 are placed in the desired area(s) in which water can accumulate and returned to the holding tank 8 to be recycled or back to a swimming pool 11. The holding tank 8 maintains a level of water that allows for enough volume of water to be forced through each nozzle 2 of the splash pad 1 at one time if necessary. The auto water leveler 9 in the holding tank maintains the necessary capacity of water needed to supply the entire system. The holding tank can be uniquely designed with a grease trap that allows for separation of waste particles found in the recycled water. A chlorine feeder may be used to sanitize the water with chlorine or bromine. An ozonator may also be used to sanitize and/or purify the water. The splash pad plumbing connection material 12 is composed of plastic or metal in a variety of diameters to ensure proper pressure, water flow and stability. The splash pad kit FIG. 1 and FIG. 2 are activated by using an activation switch FIG. 12 (e.g., timer, sensor, etc.) that allows power to the system.

Individual Components

Water Pump and Filter

In some embodiments, an electronically operated water pump 7 is the main motivator in the recirculation of the water from the splash pad 1. When in operation the water is continually recycled, pressurized and fed through a filtration system 6 and returned to the splash pad 1. The pressure-fed filter 6 is usually placed in-line immediately after the water pump 7. Different types of media are placed within the filter 6 to reduce contaminants in the water. Many different pump and filter configurations can be used in a splash pad kit FIG. 1 or FIG. 2. The pump and filter can be used as individual units or incorporated into one kit (or skid). The Stand Alone Splash Pad Kit pump and filtering system can be smaller in power and capacity than one used for a standard swimming pool due to the amount of water used in its process.

Water Holding Tank

The water used in a splash pad system can be held in a proprietary designed splash pad holding tank (or reservoir) 8. This tank can be generally configured to meet the volume of water required by the size of the water distribution valve 4 and the number of housing/nozzles 2 used on the splash pad 1. The holding tank 8 can be manufactured out of a variety of materials such as, but not limited to, fiberglass, plastic or metal. Often the holding tank 8 will be placed below the grade of the splash pad 1 to allow gravity to feed the runoff from the splash pad 1 back to the holding tank 8 via the drain(s) 3. The water is pumped from the holding tank 8 via the water pump 7 and fed through the recycling process back to the splash pad 1. The water holding tank 8 is generally accessible to allow for the cleaning of debris that may find its way into the tank—this is often done from a lid placed on top of the tank which is secured by a locking mechanism. To ensure that the system maintains a sufficient amount of water needed to supply the splash pad 1, an auto water leveler 9 can be added to the water holding tank 8. To increase the sterilization of the water a grease trap (or compartment) is incorporated into a splash pad holding tank 8.

Auto Water Leveler

The Auto Water Leveler 9 is a device that can be placed in the splash pad holding tank 8 to automatically regulate the amount of water in the holding tank 8. When the water in the tank 8 drops below the prescribed level, the unit meters in additional water until the proper levels are achieved. If water levels are too high the unit can have a built in overflow that will take out the excess amount of water out of the system.

Figure 4:
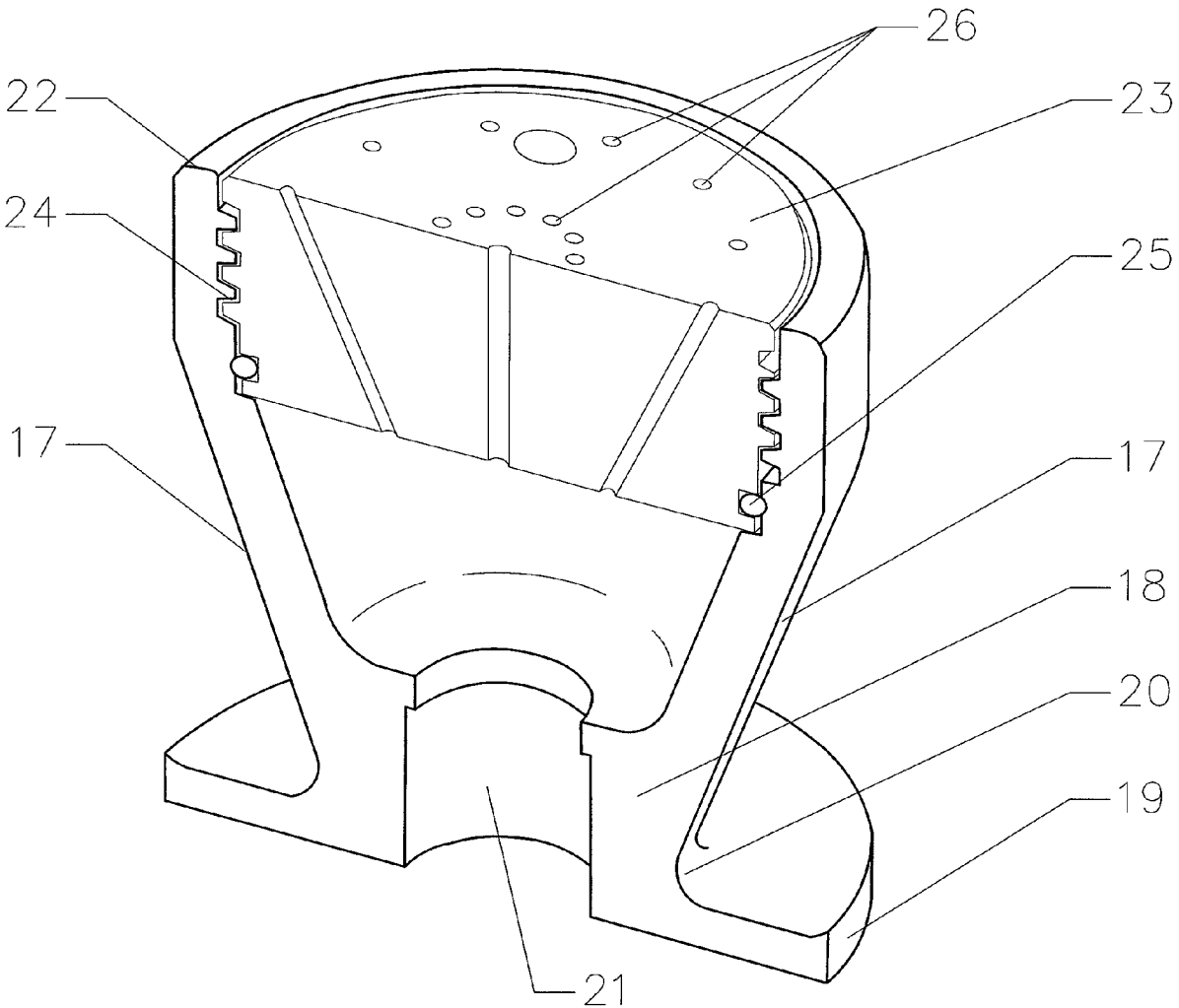
FIG. 4 shows an embodiment of a Shower Nozzle and Housing (cross-section).
Figure 10:
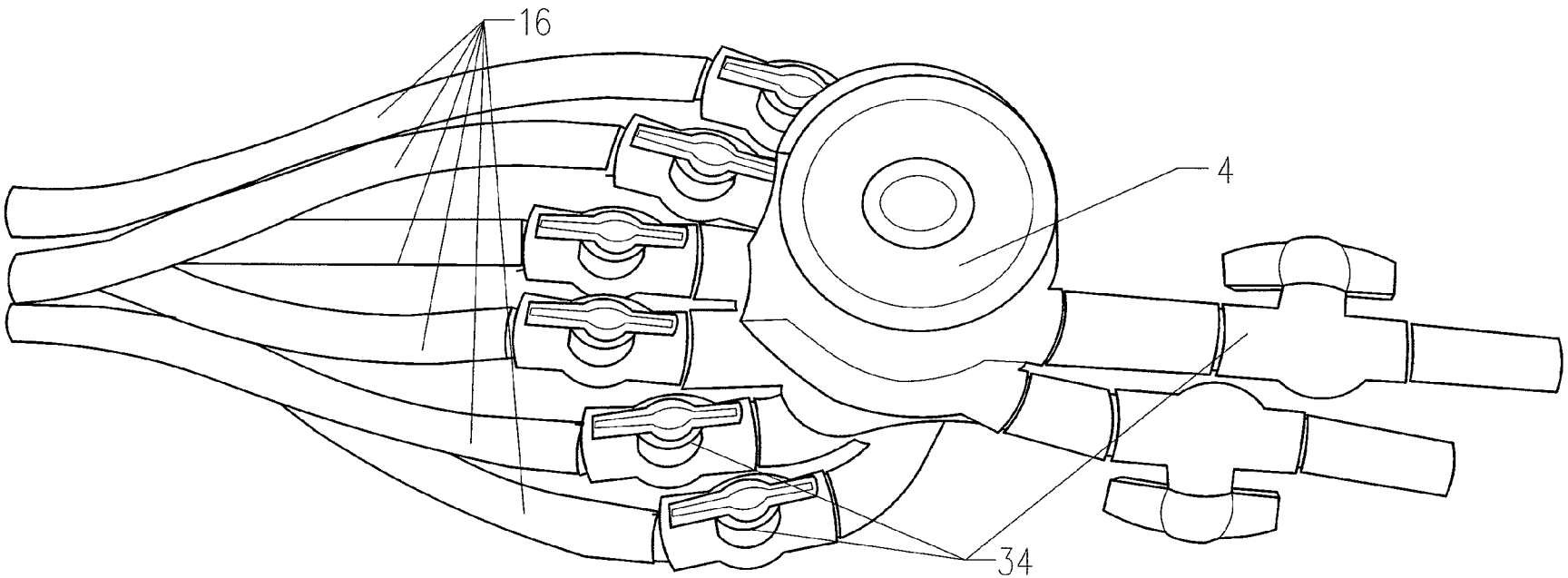
FIG. 10 shows an embodiment of an Automatic Water Distribution Valve.
Figure 11:
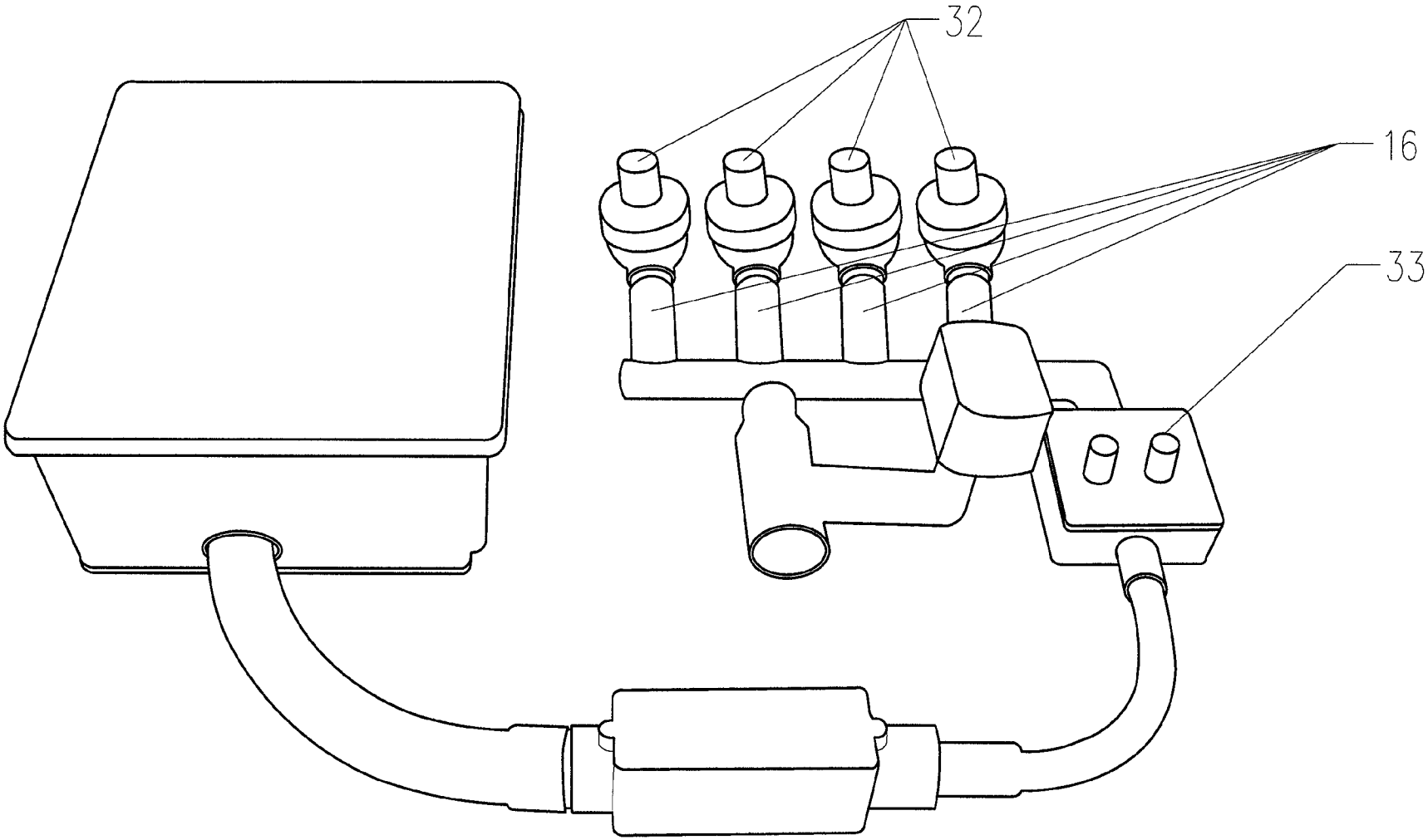
FIG. 11 shows an embodiment of an Electronic Water Distribution Valve.

Water Distribution Valve (FIG. 10 & FIG. 11, 4)

In some embodiments, the water distribution valve 4 is placed in-line after the water has left the pump 7 and filtering system 6. With the Automatic Water Distribution Valve FIG. 10 The water is forced through the value 4 to produce a predetermined pulsating pattern at the housing/nozzles 2 based on the configuration within the valve 4. The configuration is based either on the design of the distribution plate at the opening of the valve lines 16 or controlled by solenoid valves 32. The distribution valve 4 can either be controlled electronically FIG. 11 via a control station 33 or hydraulically FIG. 10. The number of distribution lines 16 helps to determine the number of housings/nozzles 2 used in the splash pad 1. To ensure the proper pressure to each housing line you must not over extend the capacity of each distribution port from the valve 4.

Ball Valve

A ball valve (e.g., the ball valve 34) is a valve that opens by turning a handle attached to a ball inside a valve. The ball has a port (or hole) through the middle so that when the ball is turned in-line to the ends of the valve it will allow water to pass through. When the valve is closed the water is shutoff from passing through the valve. Through slight degrees of adjustment the amount of flow control to the housing/nozzles 2 can be regulated to achieve the desired formation of the water feature. The ball valve can come in many material and sizes but most often it is made of a PVC material. The desired shape is a straight in-line ball valve.

Three-Way Valve

In some embodiments, the three-way valve 5 can be used in the splash pad kit FIG. 1 and FIG. 2 to direct the water to the water distribution valve 4 or to the holding tank 8 or both. The opening of the aperture within the valve also helps to dictate the water pressure as it travels to the water distribution valve 4.

Figure 3:
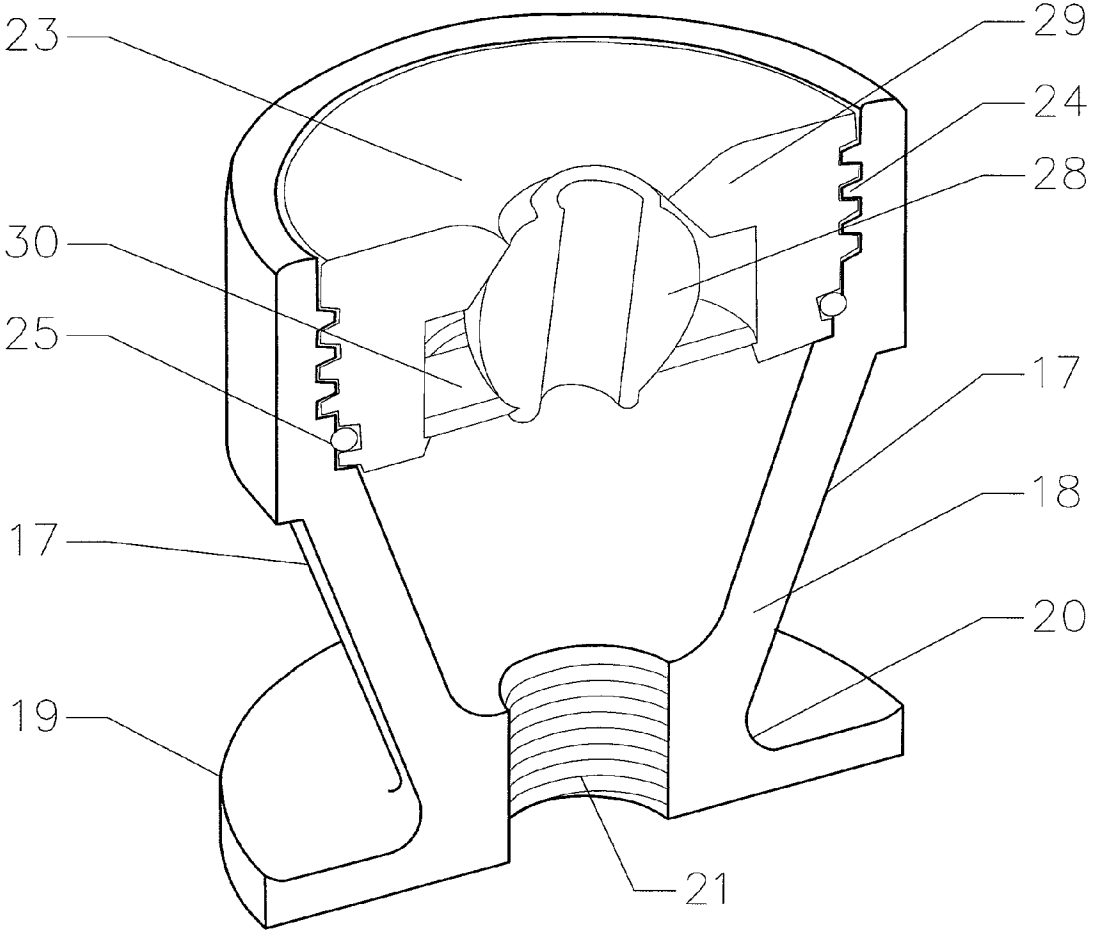
FIG. 3 shows an embodiment of an Adjustable Nozzle and Housing (cross-section).

Housings & Nozzles (FIG. 3,4,5,6)

In some embodiments, the prominent features of a splash pad kit (see FIG. 1 and FIG. 2, for example) are the water features. The features can be housings/nozzles FIG. 3,4,5,6, inset into the surface material or above grade apparatuses FIG. 9. There can be any number of housings/nozzles 2 within a splash pad 1 with a variety of spray configurations (or shapes) FIG. 3,4,5,6. Usually the number of housings is determined by the water distribution valve 4 used in the complete splash pad kit. There are multiple options in the market for housings/nozzles. Almost all housings/nozzles today are produced for the use in commercial grade applications. Because of their specified use the materials used to manufacture the components are usually a metal material. The development and use of durable plastic materials allow for a more affordable product to be sold to residential and commercial consumers.

Example: Housing and Nozzles

Referring in particular to FIG. 3,4,8, the tapered shape 17 of the body of the housing 18 can allow for strong adherence in the concrete splash pad 1. The tapering 17 aspect helps to keep the housing 18 from slipping from its position within the concrete because the housing is essentially anchored in the concrete where the water stop 19 and the base of the tapered section 17 meet 20. Many designs in the market follow a more cylindrical shape which may cause the housing 18 to turn within the concrete because it has a continuous smooth running edge. The upper ribbed collar also helps the housing resist turning when positioned within the concrete. The water stop lip 19 at the bottom of the housing can help inhibit the passage of water drainage to the compacted base material. The female fitting (threaded or slip-fit) 21 to the housings 18 allows for more convenient plumbing to the system. The rolled or smooth edge 22 on the top of the housing 18 provides a clean or finished presentation of the housing/nozzle 2 when placed in the concrete pad and helps to avoid injuries that may be caused when the edge is unfinished and/or at a sharp angle.

During installation the housing 18 is mounted in a position that relates to the center or specific point on the splash pad 1. This is done to ensure that when a nozzle 23 is switched out the new nozzle pattern will line up correctly to the center of specified point on the splash pad. To create this unique feature there is a reference point on the housing that relates to where the threads start and end within the housing.

Figure 6:
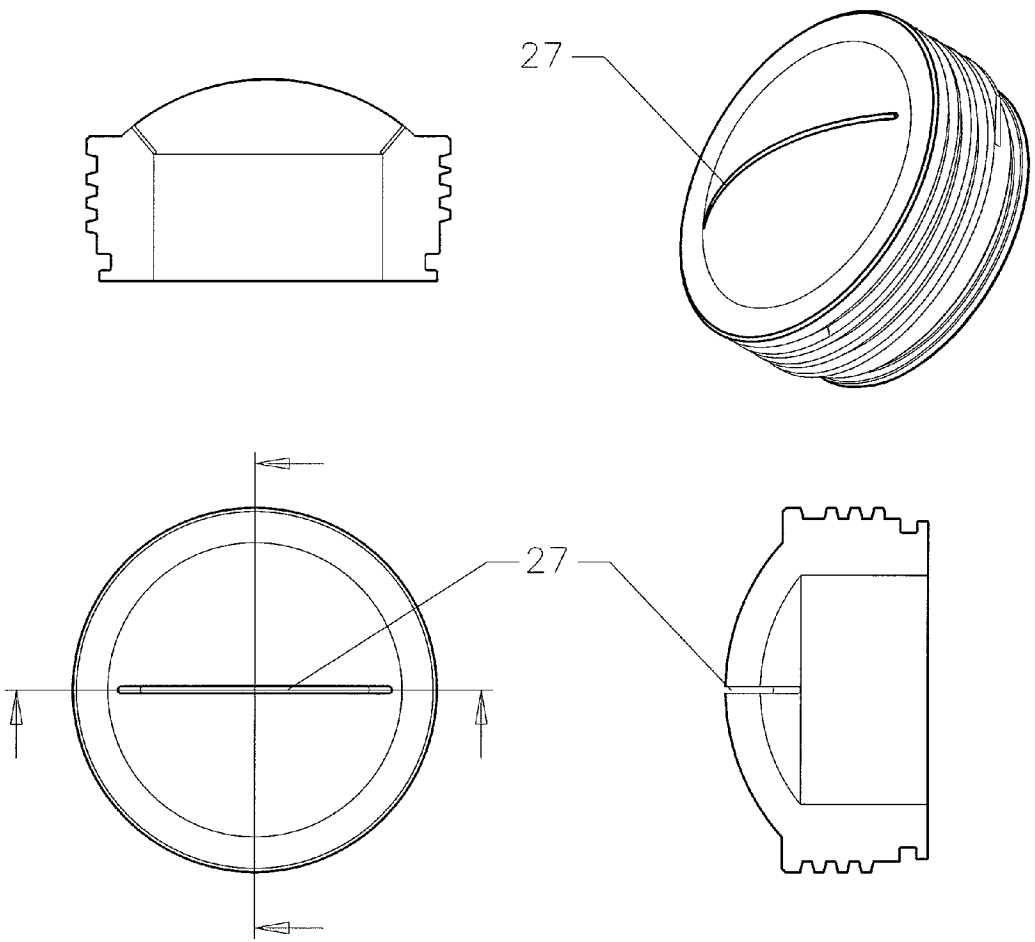
FIG. 6 shows an embodiment of a Fan Nozzle

An embodiment of a nozzle 23 or puck is described below. The nozzle 23 incorporates many design features that provide the end user the ease of installation and option to interchange water features. The nozzle 23 can be attached to the housing 18 via a threading system 24. This threading 24 allows for added strength and water tight seal. To increase the effectiveness of the water tight seal there is an added o-ring seal 25 placed below the threads 24 of the nozzle that comes in contact with the housing 18 when seated to its base threads. The drill patterns in a nozzle affect the shape of the water that sprays 15 from its openings. Each nozzle drill pattern can be oriented in a way that lines up to the center or specified point on the splash pad 1 when the nozzle 23 is seated to the bottom of the threads 24 within the housing 18. A specific orientation of the housing in the splash pad 1 provides that when nozzles 23, 2 are interchanged the spray patterns are oriented to the center or specified point on the splash pad 1 in a particular way. The following are some, but not limited to, water flow designs of the nozzle: straight shot which sprays a single stream of water vertically into the air at multiple desired heights and volumes. Shower shot FIG. 4 which sprays from multiple holes 26 within the nozzle that are set at different angles to produce a traditional fountain affect. Fan shot FIG. 6 is designed with a thin elongated opening 27 which produces a fan shape to the water. The elongation of the opening 27 determines the width and height at which the water is sprayed. Angle shot which sprays any shape and volume of water at an angle suitable to reach a desired location on a splash pad 1. Angle shots can be in single shot form or fan shape. The angle shot is usually placed on the outer perimeter of a splash pad 1 and is shot across the diameter of the splash pad 1. Adjustable shot FIG. 3,8 is a standard nozzle for a splash pad kit because it allows for the placement of the housings to be almost anywhere on the splash pad due to the fact that the ball swivel 28 can be manipulated to a desired angle. It also allows for corrections to be made to offset any placement problems when the housing 18 is not level to the surface 14 of the splash pad 1. The adjustable shot FIG. 3,8 includes components that allow for adjustment incorporated into the nozzle itself.

Figure 5:
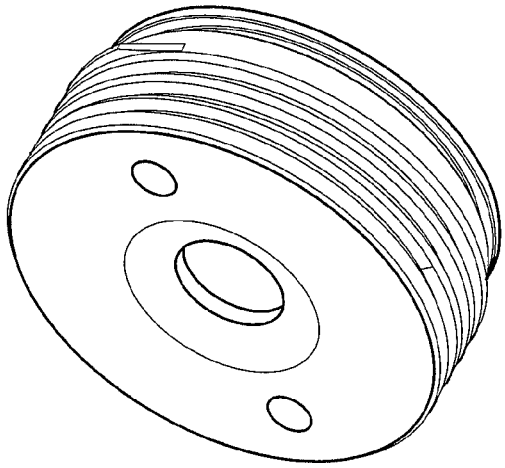
FIG. 5 shows an embodiment of a Bubbler Nozzle
Figure 5:
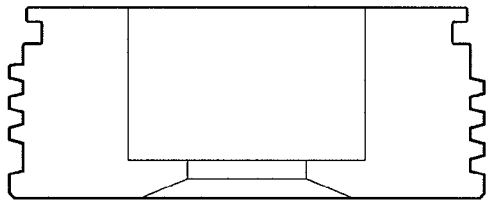
Figure 5:
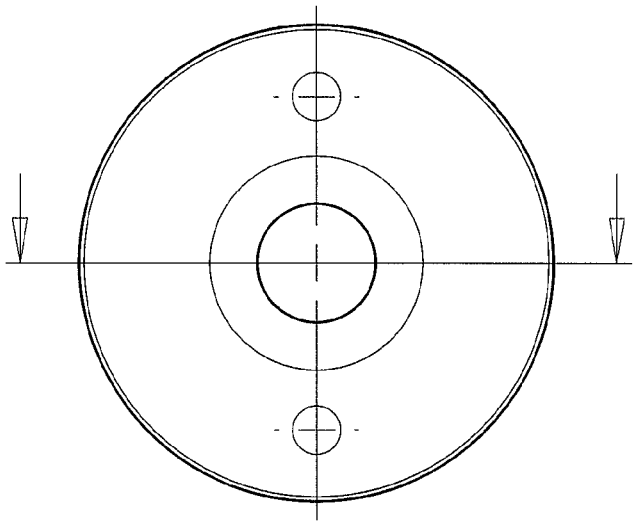

In some embodiments, there are three components of the ball swivel adjustable shot that produce the adjustability of this nozzle—the adjustable nozzle 29, the ball swivel 28 and the ball swivel washer 30 which holds the ball swivel 28 to adjustable nozzle 29. The bubbler shot is designed to allow a larger volume of water to be expelled from the housing. The bubbler nozzle FIG. 5 is usually designed to shoot vertically but with a smaller height than what a single shot nozzle can produce due to the larger nozzle opening. The bubbler nozzle can be feed directly from the pump 7 and filter 6 or given a dedicated line from the water distribution valve 4, not split in two like the usual housing/nozzle 2. Nozzles in design are the following: Spinner shot which sprays a rotating stream of water in a circular pattern into the air by forcing water across a horizontal flush mounted propeller piece mounted on the top of the nozzle. The zigzag shot is similar in design to the ball swivel adjustable shot but can be different in that the compression of the ball swivel washer is less to allow for a free pattern of spray from the ball swivel. The adjustable pin on the tool is not used on the zigzag shot. The tree shot is similar in water pattern (height and volume) as the single shot with a single shot in the middle and two angled holes offsetting the middle shot to its sides. The housings and the nozzles can be manufactured in many sizes to allow other features to be attached to the housing 18 via a threaded fitting 24, of similar nature to the nozzles 23, on the bottom of any above surface feature.

Figure 7:
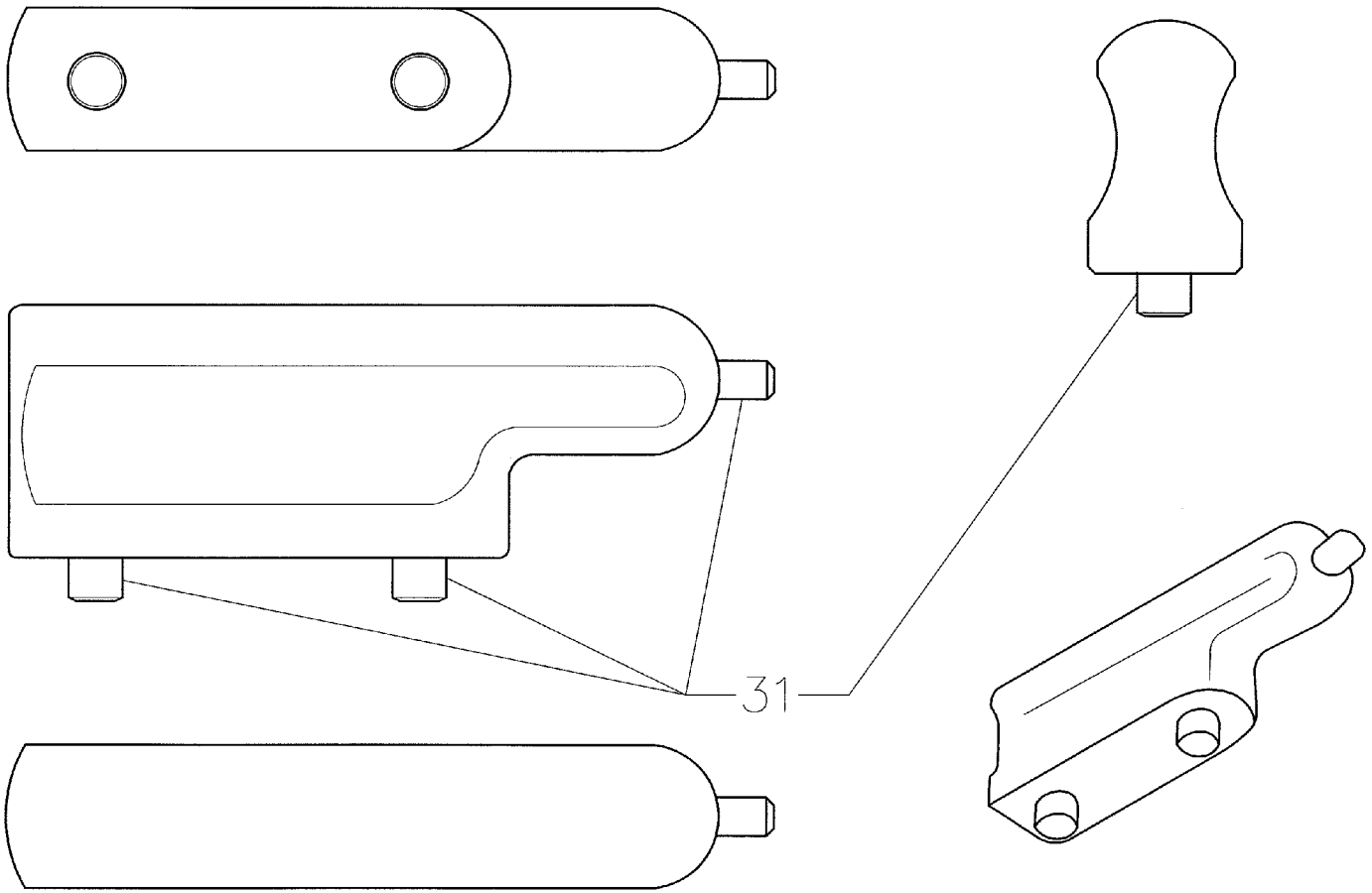
FIG. 7 shows an embodiment of a Tool
Figure 8:
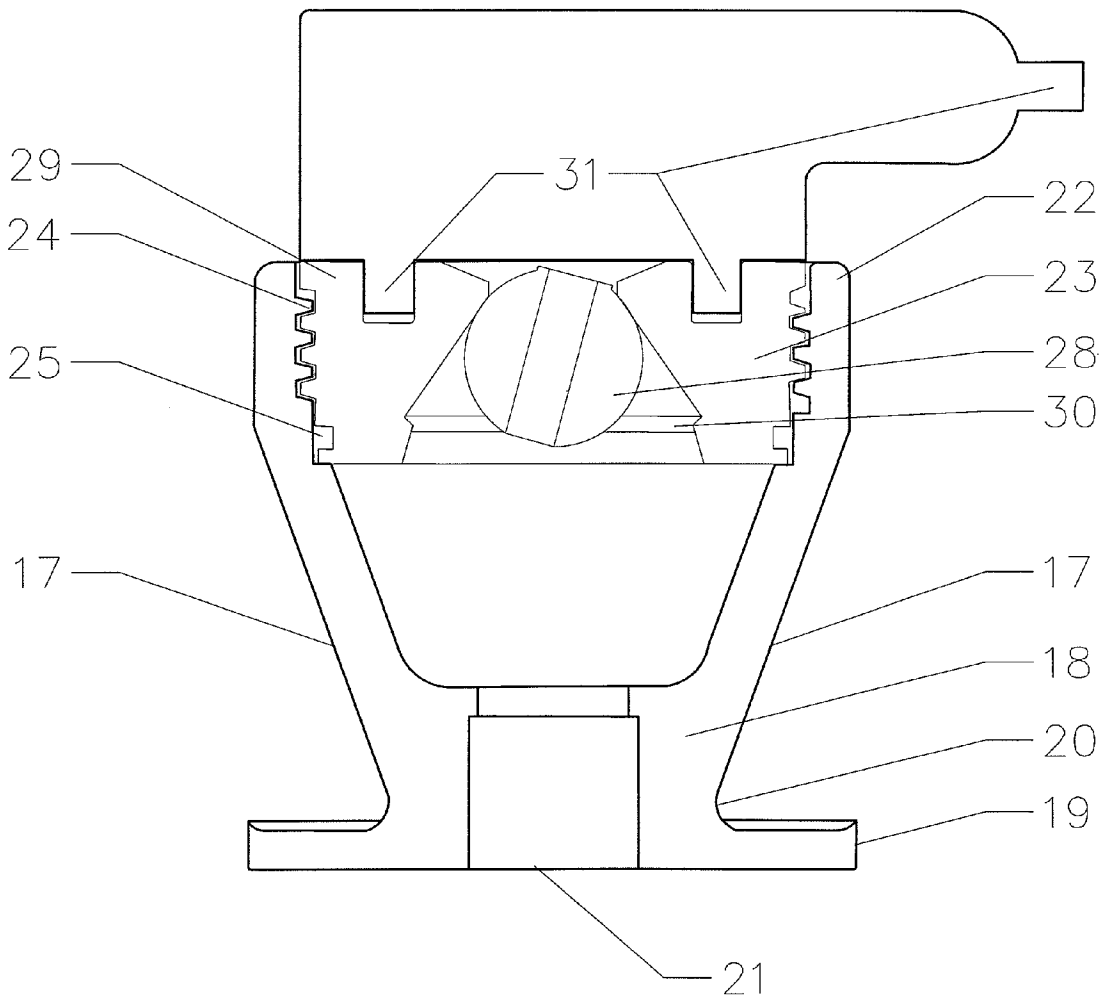
FIG. 8 shows an embodiment of a Tool and Adjustable Nozzle marriage (cross-section).

In some embodiments, an installation tool FIG. 7,8 is used to turn-in and turn-out the nozzles 23 from the housing 18. The tool can be designed with multiple pins 31 that are inserted into the top of the nozzles FIG. 8 that allow for the turning of the puck. The tool also is designed with other features that allow for adjustability of specific features within unique nozzles. One example of the adjustability portion of the tool is when an adjustment needs to be made to the adjustable nozzle FIG. 3,8. The single pin on the tool is inserted into the spout of the ball swivel adjustable shot and then manipulated to the desired angle at which the water will shoot. The tool is manufactured in a variety of materials such as plastic and metal in various embodiments for acceptable rigidity, manufacturability, durability, and ease of use.

Above Ground Water Feature (FIG. 9)

Above ground water features (for example, those illustrated in FIG. 9) can be an optional items added to a splash pad kit.

Surface Material

The various types of finish, or surface materials 14 that can be used on the surface of a splash pad 1 are numerous. The following are examples of surface materials used: rubber, acrylic, tile, stamped concrete, colored concrete, raw concrete, pavers, stone slab, asphalt, none-slip materials, thermoplastic rubber, pebble flex. Some surface materials can be packaged with the splash pad kit.

Drain(s)

The use of a drain(s) 3 allows collection of water from off the splash pad 1 and either recycles it back through the system, via the holding tank 8 or swimming pool 11. Multiple designs of drains 3 are available and can effectively perform the task.

Chlorine Feeder

Some embodiments can include a chlorine feeder to maintain a consistent feed of chlorine into the splash pad kit. The use of chlorine or bromine is to sanitize the recycled water within the system.

Ozonator

In some embodiments, an ozonator inserts ozone into the water to help with sanitization. Ozone has a short life span so it may be necessary to use other chemicals to help completely sanitize the water. Besides purification, the benefits of ozone are that it leaves no odors and it does not irritate the eyes or skin and is gentle to splash pad products. One specific reason an ozonator is used in a splash pad is when a rubber surface is applied it offsets the deterioration capabilities of chlorine.

Plumbing Connection Material

In some embodiments, a plumbing connection material 12 is present. Plastic and metal in multiple lengths and diameters can be used in the splash pad kit FIG. 1, 2. The determination of diameters is determined upon the flow of water needed between different parts in the system. Multiple forms of connections can be utilized to affect the expansion and pressure of the system. One example is that of ball joints that are utilized in-line to help regulate the pressure to the housings.

Figure 12:
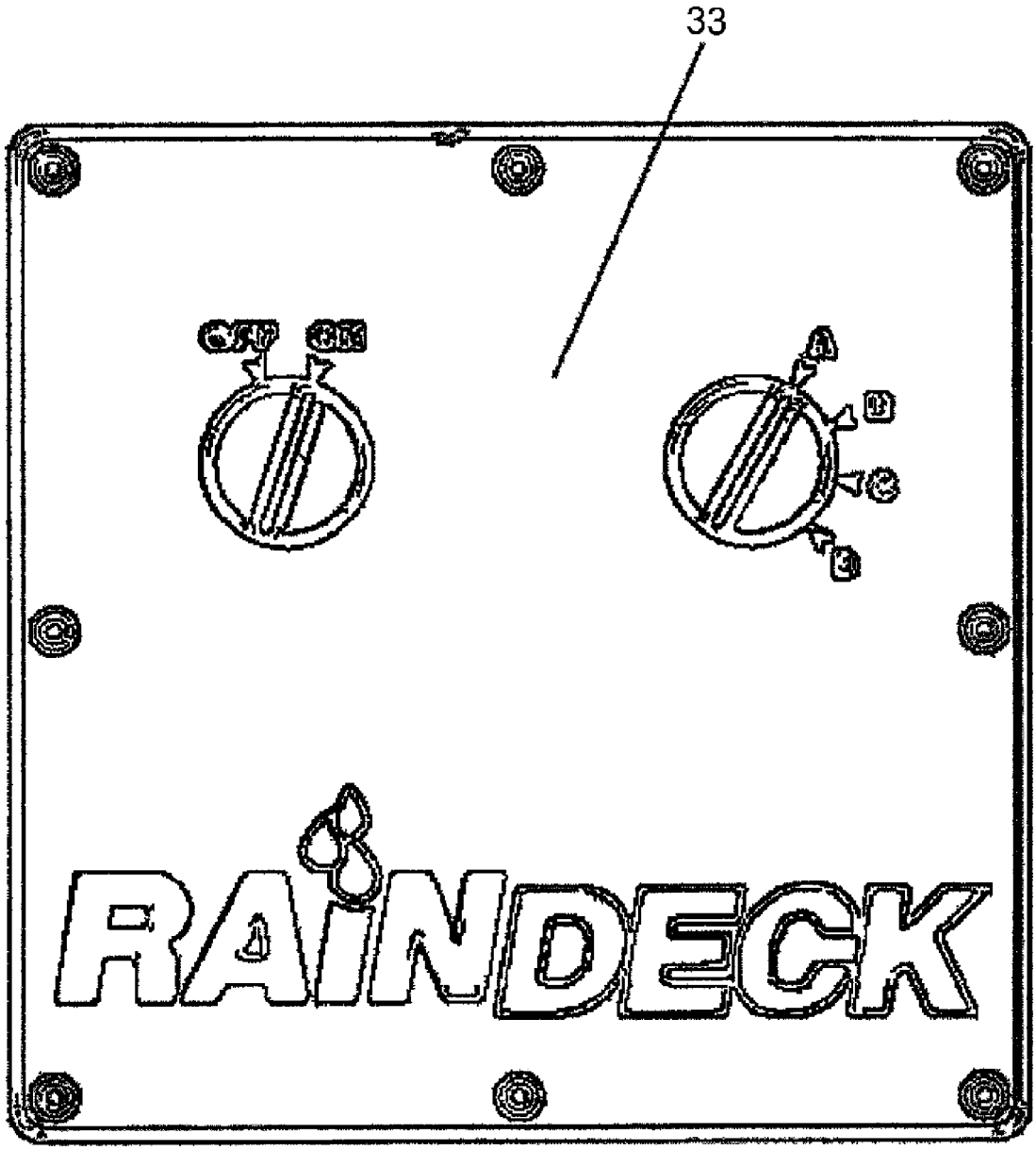
FIG. 12 shows an embodiment of a Face Plate for an Electronic Water Distribution Valve.

Activation Switch (FIG. 12)

In some embodiments, functionality of the splash pad kit FIG. 1, 2 is improved by including an activation switch to turn power on and off. This function can be accomplished with a multiplicity of products such as a simple toggle switch or a highly programmable electronic panel that can dictate the time frame the splash pad operates.

Although described in the illustrative context of certain preferred embodiments and examples, it will be understood by those skilled in the art that the disclosure extends beyond the specifically described embodiments to other alternative embodiments and/or uses and obvious modifications and equivalents. Thus, it is intended that the scope of the claims which follow should not be limited by the particular embodiments described above.

What is claimed is:

1. A splash pad system configured for residential installation to provide controlled water delivery through openings in a residential splash pad for water entertainment, the system comprising:

a residential water pump configured to take in water and urge the water in a first direction along a fluid circuit;

a water filter that is in fluid communication with the water pump and that is configured to receive water moving in the first direction, remove particles from the water to filter the water, and allow the filtered water to continue along the fluid circuit in the first direction;

a water distribution valve that is in fluid communication with the water filter, the water distribution valve configured to receive water moving in the first direction, distribute the water into multiple feed lines and allow the water to continue to flow through the fluid circuit in the first direction through the feed lines;

a splash pad comprising a level surface having openings;

nozzles that are configured to receive water from the water distribution valve through the multiple feed lines and project the water out beyond the openings in the splash pad such that the water flows into one or more of the air above the splash pad and/or above-ground water features;

a drain in the splash pad; and a water leveling reservoir that is configured to receive and retain water from a water supply and from the drain, the reservoir in fluid communication with the water pump and configured to allow water to flow thereto.

2. The system of claim 1, further comprising a heating element configured to heat the water in the fluid circuit before the water is projected from the nozzles.

3. The system of claim 1, further comprising at least one ball valve on a feed line.

4. The system of claim 1, wherein at least one of the nozzles is a substantially round disk.

5. The system of claim 1, wherein the splash pad further comprises a surface material selected from the group consisting of rubber, acrylic, tile, stamped concrete, colored concrete, raw concrete, pavers, stone slab, asphalt, none-slip materials, thermoplastic rubber, and pebble flex.

6. The system of claim 1, wherein the water leveling reservoir is a swimming pool.

7. The system of claim 1, further comprising a chlorine feeder configured to introduce chlorine into the water in the fluid circuit.

8. The system of claim 1, further comprising pipes that provide fluid communication between each of the components of claim 1.

9. The system of claim 1, further comprising a residential activation switch configured to determine when electrical power is supplied to the pump.

10. The system of claim 1, further comprising an automatic water leveler in fluid communication with the reservoir.

11. The system of claim 1, further comprising a swimming pool in fluid communication with the fluid circuit.

12. The system of claim 1, further comprising a three-way valve and bypass.

13. The system of claim 1, wherein at least one of the nozzles is located at the perimeter of the splash pad and is configured to deliver an angle shot of water.

14. The system of claim 1, further comprising an above-ground water feature configured in the shape of an umbrella.

15. The system of claim 1, further comprising an above-ground water feature configured in a shower shape.

16. The system of claim 1, further comprising, further comprising an ozonator configured to introduce ozone into the fluid circuit.

17. A splash-pad installation kit comprising a package having each of the components of claim 1 in an un-installed state.

* * * * *